United States Patent [19]

Bruno

[11] 4,098,107

[45] Jul. 4, 1978

[54] VARIABLY POSITIONABLE ROLLING STAND

[75] Inventor: Vincenzo Bruno, Busto Arsizio (Varese), Italy

[73] Assignee: Pomini Farrel, S.p.A., Italy

[21] Appl. No.: 795,810

[22] Filed: May 11, 1977

[51] Int. Cl.[2] ..... B21B 31/02

[52] U.S. Cl. ..... 72/237

[58] Field of Search ..... 72/237, 226, 249, 235, 72/238, 231

[56] References Cited

U.S. PATENT DOCUMENTS

| | | | |
|---|---|---|---|
| 3,298,214 | 1/1967 | Stubbs et al. | 72/237 X |
| 3,319,449 | 5/1967 | Hill | 72/237 |

*Primary Examiner*—Milton S. Mehr

*Attorney, Agent, or Firm*—Shlesinger, Fitzsimmons & Shlesinger

[57] ABSTRACT

This invention relates to a rolling stand of transformable type, i.e. movable between two positions 90° apart, in which the rolls maintain the same rolling axis. The main feature of the rolling stand according to the invention consists in that the stand is connected to a fixed base by a generally triangular hinged connection system with one side of variable length.

4 Claims, 3 Drawing Figures

VARIABLY POSITIONABLE ROLLING STAND

This invention relates to a rolling stand the rolls of which may be disposed either horizontally or vertically, for operating with rolling cross-sections at 90° to each other.

Flat metal sections and relatively light-weight shaped metal sections, the so-called light sections, are generally produced by hot rolling ingots or billets, these latter being obtained by blooming or continuous casting.

The starting product is reduced in cross-section in several consecutive passes through a plurality of rolling stands. In this respect, it passes directly from one rolling stand to the next such that it is simultaneously engaged by more than two stands.

As is well known to experts of this particular branch of the art, cross-sections disposed at 90° to each other have to be rolled consecutively in this type of rolling. During the passes of this type, any twisting of the contour must be prevented so as not to give rise to dimensional defects. It is also necessary for the rolling line to be straight so as not to create difficulties for the lead-ins for the rolling cross-sections, which would considerably lower the production rate and overall efficiency of the installation.

In addition, especially in this type of rolling, the intermediate and nearly finished contours also require lateral upsetting to eliminate the excessive bulging of the corners.

Finally, to roll different finished dimensions a larger or smaller number of stands are used, i.e. the product, which undergoes a larger or smaller number of passes, is finished on a larger or smaller number of upstream stands. For this, the vertical or upsetting passes may have to be moved to different stands.

The aforesaid requirements and others relative to the flexibility of the rolling programme require the use, in a rolling train, of so-called "transformable38 rolling stands, i.e. stands the rolls of which may be disposed at will with their axes vertical or horizontal.

Various types of transformable stands are known. The most well known is perhaps that described and illustrated in Italian Pat. No. 763,354 of Morgan Construction Co.

The rolling stand according to the Morgan patent comprises a support structure formed from two shoulders provided with semicircular apertures, the centre of which corresponds to the centre of the stand, i.e. the rolling line. At the edge of said apertures there are provided circular rails concentric with the edge, and on which support wheels for the entire rotating complex run. The rotation is by a geared motor or other equivalent systems, the system being a self-contained one forming part of the stand.

For correct rotation and positioning of the rolling rolls, a stand constructed in this manner requires the support structure briefly described above to be constructed with the maximum precision. This is obtainable only with large special machine tools using costly equipment, as the surfaces concerned are of considerable size.

The manufacture of transformable stands of this type is thus very costly.

The object of the present invention is to provide a rolling stand capable of being disposed with its rolling rolls in a horizontal or vertical position, the manufacturing cost of which is considerably less than that of stands of the same type at present used in hot rolling installations.

This object is attained according to the present invention by a rolling stand of transformable type, i.e. movable between two positions 90° apart, in which the rolls maintain the same rolling axis, characterised by being connected to a fixed base by a generally triangular hinged connection system with one side of variable length.

The structural and operational characteristics of the invention and its advantages relative to the known art will be more evident from an examination of the description given by way of example hereinafter with reference to the accompanying drawings, in which.

Figure 3:
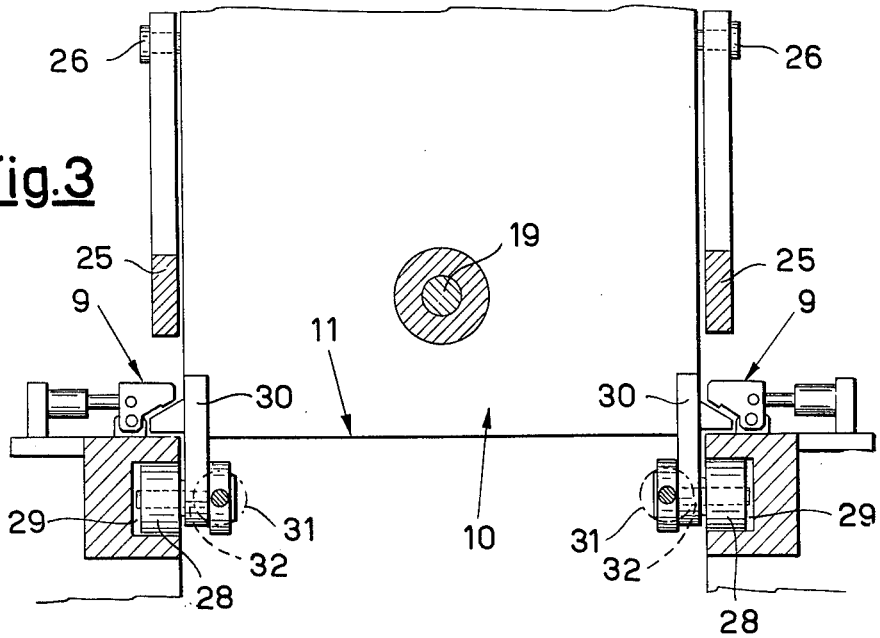
FIG. 3 is a section on the line III—III of FIG. 1.

With reference to the drawings, the rolling stand according to the invention is indicated overall by the reference numeral 10, has a generally C-shaped profile and is mounted on a base 11. The stand is releasably connected to the base by so-called pincers of known type and illustrated diagrammatically at 9 in FIG. 3. The reference numeral 12 indicates the two rolling rolls driven by a motor 13 through a kinematic chain formed by a driveshaft 14, a mechanical clutch 15, a first driven shaft 16, two half couplings 17, 18, a second driven shaft 19, a bevel gear pair 20, a third driven shaft 21, and a train of reduction gears 22 to which the transmission shafts 23 rigid with the rolling rolls 12 are connected. With the free end of the shaft 21 there is rigid a half coupling 24 equal to 18, and arranged to be connected to the half coupling 17 as will be explained hereinafter.

According to the invention, the stand 10 and base 11 are interconnected by a pair of struts 25 (FIG. 3), each of which is pivoted at 26 to the stand and at 27 to the base.

Furthermore, the stand may move along the base as it is connected to it by a carriage formed from a pair of idle wheels 28 slidable in guides 29 in the base and supported by arms 30 rigid with the stand at its corners. A pair of hydraulic telescopic jacks 31 acts on said arms 30 respectively, one end being connected to the base and the other end pivoted to said arms at 32. Thus, as is evident from the detailed view of FIG. 3, said arms 30 and consequently the entire stand can rotate about 32.

The position of the rolling stand is varied in the following manner.

Figure 1:
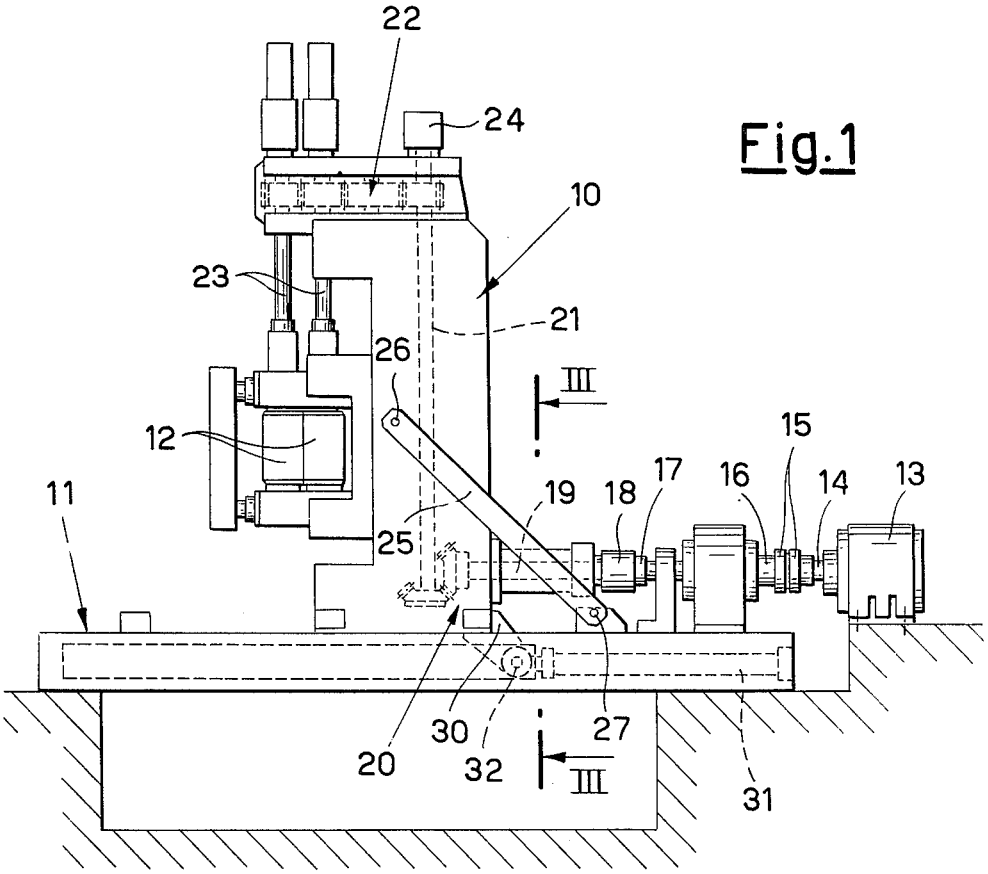
FIG. 1 is an elevation showing the rolling stand in the vertical position.
Figure 2:
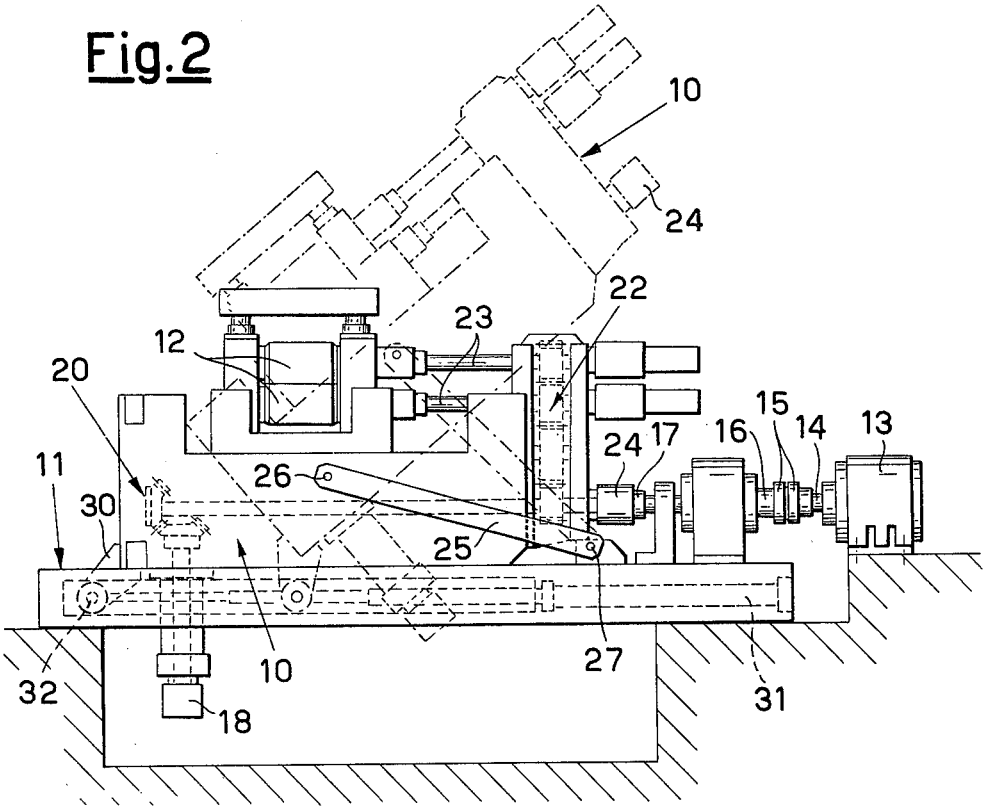
FIG. 2 is a view as in FIG. 1, but with the stand in the horizontal position.

It will be assumed for example that it is required to pass from the vertical position shown in FIG. 1 to the horizontal position shown in FIG. 2.

The half couplings 17, 18 are firstly separated, and then the pincers 9 are opened. At this point the jacks 31 are extended, the result of which is that the stand 10 is urged to move along the guides 29 and simultaneously to rotate through 90° about the pivoting points 26 and 32 to lie on the base 11, in the position shown in FIG. 2.

It will be noted that the position of the centre of the rolls 12 is identical to that of FIG. 1. The stand 10 is locked to the base by the pincers 9 and the half coupling 24 connected to the half coupling 17.

To return the stand 10 to the vertical position of FIG. 1, the operation is as heretofore described, by withdrawing the previously extracted jacks.

From the description, it is evident that the transformable stand according to the invention is of simple structure and is therefore of very rapid and economical manufacture and not requiring the use of special components difficult to machine.

Although a preferred embodiment of the invention has been illustrated and described, variations and modifications may be made to it without leaving the scope of the inventive idea as defined by the following claims.

For example, the arrangement of the jacks and struts could be different, providing the hinged kinematic connection between the stand and base comprising a triangle with one side of variable length is respected.

I claim:

1. A rolling assembly, comprising a stationary base, driving motor means fixedly supported on said base and having one driving end, a transformable rolling stand movably mounted on said base to be supported thereby, and having thereon a pair of cooperating rolls which define therebetween the rolling axis of the assembly, and linking means connecting said rolling stand to said stationary base to allow the rolling stand to be rotated about said rolling axis between two angular positions 90° apart, said linking means comprising wheel means located below said rolling stand and movable along a substantially horizontal path defined by guide means in said stationary base, and strut means pivoted at one end to said rolling stand and at another end to said stationary base outside said path for causing the rolling stand to rotate between said two angular positions responsive to reciprocation of said wheel means along said path, said rolling stand also having thereon a gear transmission system for said cooperating rolls, said system including two separate driven ends arranged to be connected selectively to said one driving end of the driving motor means upon movement of the rolling stand from one to the other of its two angular positions.

2. A rolling assembly as defined in claim 1, including actuator means connected to said wheel means and operable to reciprocate said wheel means in said guide means between first and second limit positions along said horizontal path thereby to move said stand selectively between said two angular positions thereof.

3. A rolling assembly as defined in claim 2, wherein said strut means comprises a pair of rigid links positioned at opposite sides, respectively, of said stand and exteriorly of the horizontal path along which said wheel means reciprocates, each of said links being pivotally connected at one end to said base along a stationary axis which extends parallel to said rolling axis, and at its opposite end to said stand along a movable axis which extends parallel to said stationary axis.

4. A rolling assembly as defined in claim 2, wherein said wheel means comprises a pair of spaced idler wheels mounted on said stand adjacent opposite sides thereof for rotation about an axis parallel to said rolling axis, and guided for horizontal rolling movement in spaced, horizontal grooves in said base, and said actuator means comprises at least one reciprocable jack member operatively connected to said wheels to reciprocate said wheels in unison in said grooves during movement of said stand between its two angular positions.

* * * * *